US011635193B1

(12) United States Patent
Lee et al.

(10) Patent No.: US 11,635,193 B1
(45) Date of Patent: Apr. 25, 2023

(54) RECONFIGURABLE TRACK LIGHT ADAPTERS, KITS AND METHODS

(71) Applicant: Guangzhou Panyu Target Casting And Lighting Corporation, Guangzhou (CN)

(72) Inventors: Robert Lee, Guangzhou (CN); Zhiping Huang, Guangzhou (CN); Siming Yao, Guangzhou (CN); Dingqiang Xie, Guangzhou (CN)

(73) Assignee: Guangzhou Panyu Target Casting And Lighting Corporation, Guangzhou (CN)

( * ) Notice: Subject to any disclaimer, the term of this patent is extended or adjusted under 35 U.S.C. 154(b) by 0 days.

(21) Appl. No.: 17/375,336

(22) Filed: Jul. 14, 2021

Related U.S. Application Data

(60) Provisional application No. 63/051,871, filed on Jul. 14, 2020.

(51) Int. Cl.
*F21V 21/35* (2006.01)
*F21V 21/005* (2006.01)

(52) U.S. Cl.
CPC ..... *F21V 21/35* (2013.01); *F21V 21/005* (2013.01)

(58) Field of Classification Search
CPC ..... F21V 21/35; F21V 21/005; F21V 23/06
See application file for complete search history.

(56) References Cited

U.S. PATENT DOCUMENTS

| | | | | |
|---|---|---|---|---|
| 4,822,292 | A * | 4/1989 | Thayer | H01R 25/142 439/115 |
| 5,855,485 | A * | 1/1999 | Patti | H01R 25/142 439/121 |
| 10,985,478 | B1 * | 4/2021 | Leahy | F21V 21/35 |
| 11,175,026 | B1 * | 11/2021 | Yu | F21V 21/088 |
| 2005/0169015 | A1 * | 8/2005 | Luk | H05B 45/20 362/648 |
| 2015/0198311 | A1 * | 7/2015 | O'Brien | F21S 8/066 362/220 |

* cited by examiner

*Primary Examiner* — Leah Simone Macchiarolo

(57) ABSTRACT

The present disclosure provides implementations of a track lighting adapter to couple a luminaire to a lighting track. The track lighting adapter includes a luminaire adapter to couple to the luminaire, and a track adapter to couple to the lighting track. The track adapter is selectively removable from the luminaire adapter.

14 Claims, 7 Drawing Sheets

RECONFIGURABLE TRACK LIGHT ADAPTERS, KITS AND METHODS

CROSS-REFERENCE TO RELATED APPLICATIONS

The present patent application claims the benefit of priority to U.S. Provisional Patent Application No. 63/051,871, filed Jul. 14, 2020. The aforementioned patent application is incorporated by reference herein for all purposes.

FIELD

The present patent application relates to lighting adapters.

DESCRIPTION OF RELATED ART

A variety of different approaches have been used for fitting luminaires to lighting tracks. But, existing approaches have various shortcomings. The present disclosure is directed to elements that improve on the state of the art.

SUMMARY OF THE DISCLOSURE

The present disclosure provides implementations of a track lighting adapter to couple a luminaire to a lighting track. The track lighting adapter includes a luminaire adapter to couple to the luminaire, and a track adapter to couple to the lighting track. The track adapter is selectively removable from the luminaire adapter. The track adapter can be configured to couple to a HALO® type lighting track, a JUNO® type lighting track, a LIGHTOLIER® type lighting track, a GLOBAL GB-67 type lighting track, or other type of lighting track, as desired.

In some implementations, at least one of the luminaire adapter and the track adapter can include an alignment guide to help orient the relative position of the track adapter with respect to the luminaire adapter. For example, a first alignment guide portion on the track adapter can be received by a second alignment guide portion formed into the luminaire adapter.

In some implementations, the luminaire adapter can include a coupling to removably receive the track adapter. The coupling can be defined at least in part by a recess formed into the luminaire adapter. The recess formed into the luminaire adapter can define a surface including a plurality of electrical contacts. The recess can be formed into an upper surface of the luminaire adapter that is configured to face the lighting track. If desired, the track adapter can be configured to be inserted into the recess of the luminaire adapter. The track adapter can be configured to be locked in place with respect to the luminaire adapter by moving the track adapter from a first position to a second position after the track adapter has been inserted into the recess of the luminaire adapter. This can be done by sliding, and or rotating the track adapter with respect to the luminaire adapter.

The disclosure further provides implementations of a track lighting adapter kit to couple a luminaire to a lighting track. The track lighting adapter kit can include a luminaire adapter to couple to the luminaire. The luminaire adapter includes a coupling to receive a track adapter. The track adapter is configured to couple to the lighting track. The track adapter can be selectively removable from the luminaire adapter. The kit can further include one or more track adapters to couple to the luminaire adapter. Each of the one or more track adapters can be configured to couple to a different type of lighting track. For example, the plurality of track adapters can be configured to couple to a HALO® type lighting track, a JUNO® type lighting track, a LIGHTOLIER® type lighting track, a GLOBAL GB-67 type lighting track, and/or other type of lighting track.

The disclosure further provides implementations of methods of coupling a luminaire to a lighting track. The method includes providing a luminaire adapter to couple to the luminaire. The luminaire adapter can include or be provided with a coupling to receive a track adapter. The track adapter can be configured to couple to the lighting track. The track adapter can be selectively removable from the luminaire adapter. The method can further include providing a plurality of track adapters to couple to the luminaire adapter. Each of the track adapters in the plurality of track adapters can be configured to couple to a different type of lighting track. The method can further include selecting one of the track adapters, and coupling the selected track adapter to the luminaire adapter. The method can further include coupling a luminaire to the luminaire adapter, and coupling the track adapter to the lighting track.

It is to be understood that both the foregoing general description and the following detailed description are exemplary and are intended to provide further explanation of the embodiments disclosed herein.

The accompanying drawings, which are incorporated in and constitute part of this specification, are included to illustrate and provide a further understanding of the method and system of the disclosure. Together with the description, the drawings serve to explain the principles of the disclosed embodiments.

BRIEF DESCRIPTION OF THE DRAWINGS

The foregoing and other objects, aspects, features, and advantages of exemplary embodiments will become more apparent and may be better understood by referring to the following description taken in conjunction with the accompanying drawings, in which.

DETAILED DESCRIPTION

The present disclosure is generally directed to adapters for track lighting systems. In the lighting field, contractors will sometimes buy large quantities of lighting track in bulk as this is more cost effective. However, once having committed to a particular type of lighting track, the contractor is then generally constrained to use luminaires having adapters configured for the type of track that they have selected. The present disclosure solves this problem by providing a reconfigurable track adapter that can be modified to be received by different types of lighting tracks. While four examples are illustrated below, any insert can be provided to couple the adapter body to any type of track.

Figure 1A:
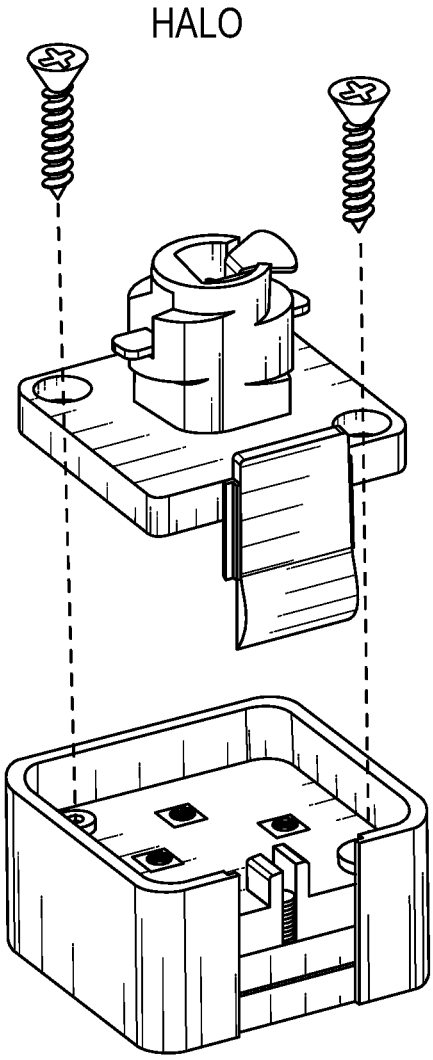
FIG. 1A is an isometric exploded view of a first representative embodiment of a track lighting adapter in accordance with the disclosure that is configured to couple a luminaire to a HALO® type lighting track.
Figure 1B:
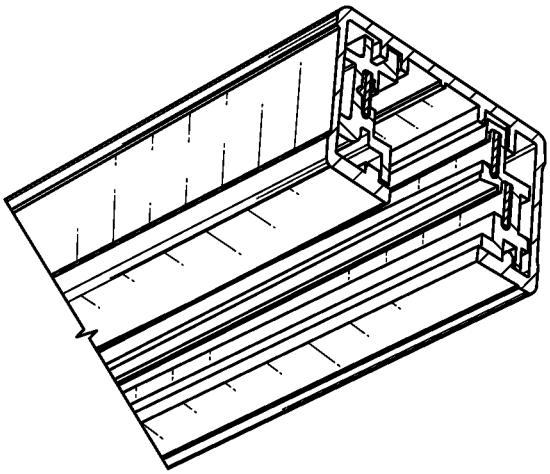
FIG. 1B is an isometric view of an end portion of a HALO® type lighting track.
Figure 2A:
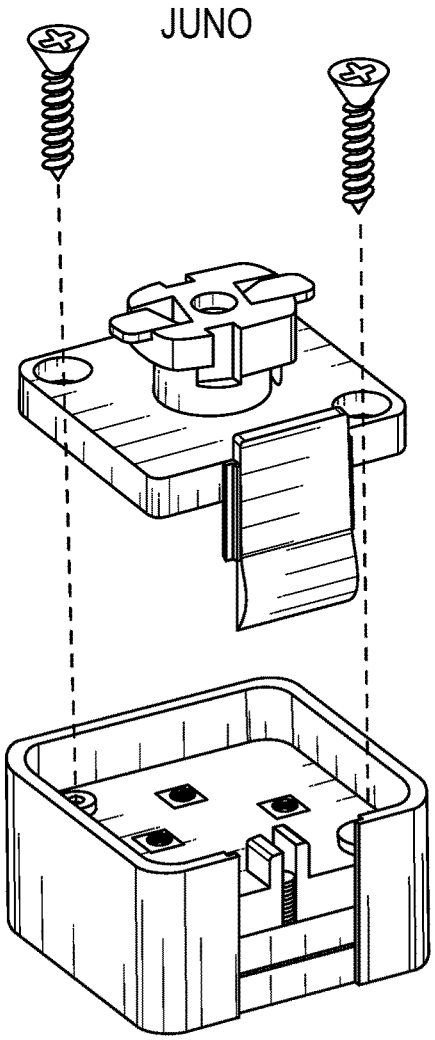
FIG. 2A is an isometric exploded view of a first representative embodiment of a track lighting adapter in accordance with the disclosure that is configured to couple a luminaire to a JUNO® type lighting track.
Figure 2B:
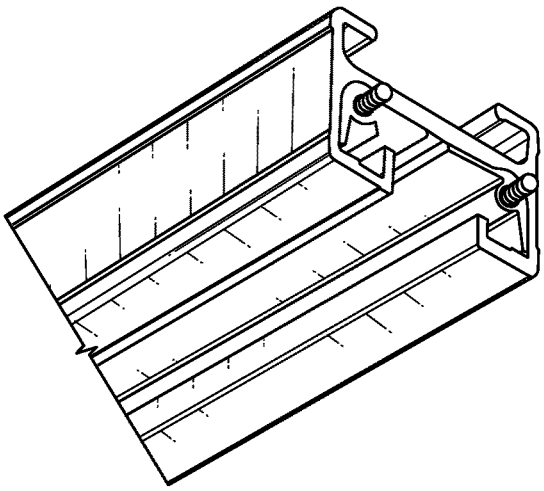
FIG. 2B is an isometric view of an end portion of a JUNO® type lighting track.
Figure 3A:
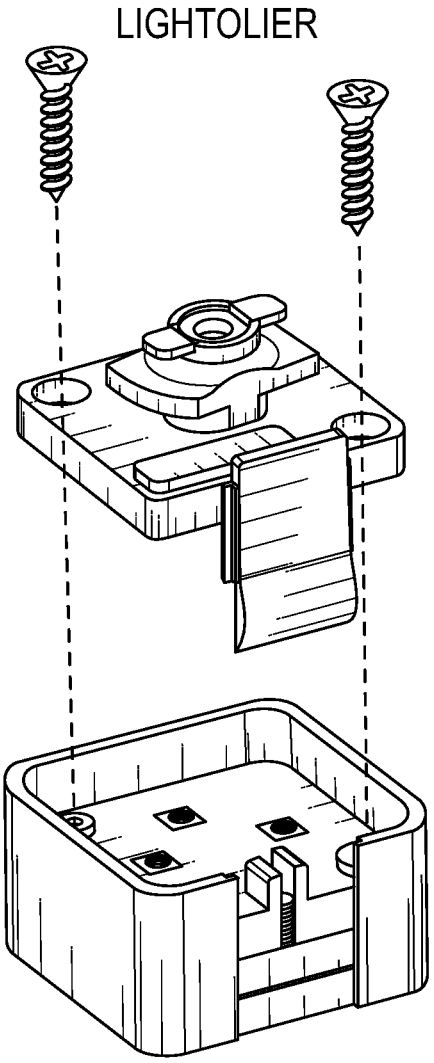
FIG. 3A is an isometric exploded view of a first representative embodiment of a track lighting adapter in accordance with the disclosure that is configured to couple a luminaire to a LIGHTOLIER® type lighting track.
Figure 3B:
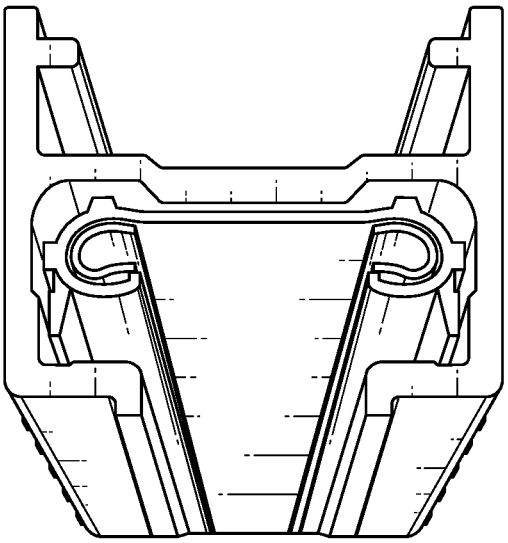
FIG. 3B is an isometric view of an end portion of a LIGHTOLIER® type lighting track.

For purposes of illustration, and not limitation, FIG. 1A is an isometric exploded view of a first representative embodiment of a track lighting adapter in accordance with the disclosure that is configured to couple a luminaire to a HALO® type lighting track. FIG. 2A is an isometric exploded view of a first representative embodiment of a track lighting adapter in accordance with the disclosure that is configured to couple a luminaire to a JUNO® type lighting track. FIG. 3A is an isometric exploded view of a first representative embodiment of a track lighting adapter in accordance with the disclosure that is configured to couple a luminaire to a LIGHTOLIER® type lighting track.

As can be seen in FIGS. 1A, 2A and 3A, each of the luminaire adapters is of the same configuration, whereas each of the track adapters is uniquely configured to be received by the lighting tracks of 1B, 2B, and 3B, respectively. Each of the luminaire adapters, as illustrated includes a portion to couple to the track adapter. The coupling can be accomplished ultimately by the securement of fasteners, such as screws to hold the luminaire adapter and track together. Alternatively, a different arrangement can be used, as with the embodiments of 4-6, described below that includes a twist lock arrangement that can be secured by a fastener or deflectable pawl and catch. Or, a snap fit connection or interference fit can be defined between the two portions as a coupling.

Figure 7:
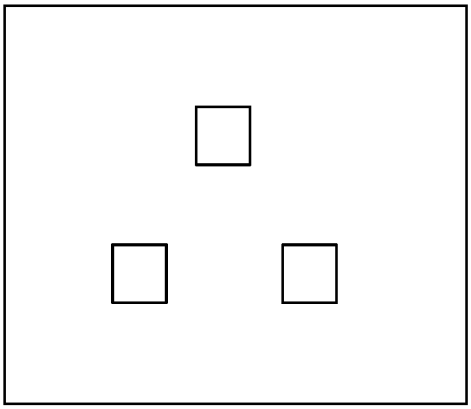
FIG. 7 is a schematic view of an underside of a track lighting adapter in accordance with the present disclosure illustrating an example of placement of electrical contacts.

As illustrated, the luminaire adapter includes a recess formed into the luminaire adapter that receives a respective track adapter therein. But, it will be appreciated that the recess can alternatively be provided on the track adapter, if a recess is provided at all. If desired, no recess may be provided and the components can simply snap together and/or be secured by fasteners. The illustrated recess formed into the luminaire adapter can define a surface including a plurality of electrical contacts that contact a plurality of electrical contacts formed on the underside of the track adapter as illustrated in FIG. 7, wherein each of the contacts can connect to a conductor that couples to the lighting track. As illustrated, the track adapter is configured to be inserted into the recess of the luminaire adapter.

As is also illustrated in FIGS. 1A, 2A, and 3A, the luminaire adapter and each of the track adapters can include an alignment guide to help orient the relative position of the luminaire adapter to the track adapter. As illustrated, a first alignment guide portion on the track adapter is received by a second alignment guide portion formed into the luminaire adapter. The track adapter in each example includes a downwardly depending key that fits into a slot on one side of the luminaire adapter, but it will be appreciated that any suitable alternative alignment structure can be used. This helps to prevent incorrect alignment between the adapter body and track adapter. Indicia can further be provided to indicate which direction to rotate the assembled adapter in so as to couple it to the lighting track.

Figure 4:
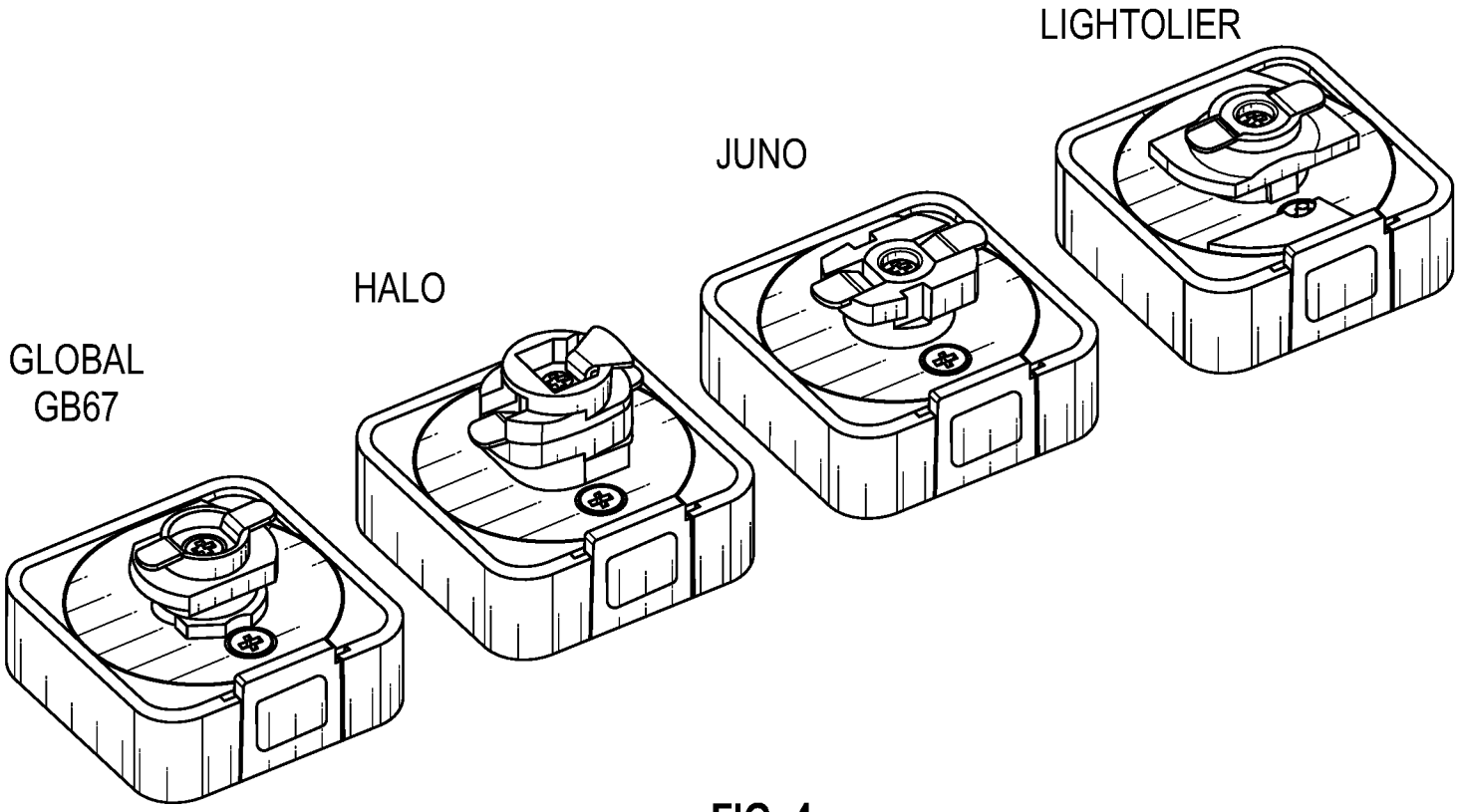
FIG. 4 is an isometric view of a second representative set of track lighting adapters in accordance with the present disclosure configured to couple a luminaire to a GLOBAL GB-67 type lighting track, a HALO® type lighting track, and a LIGHTOLIER® type lighting track.
Figure 5:
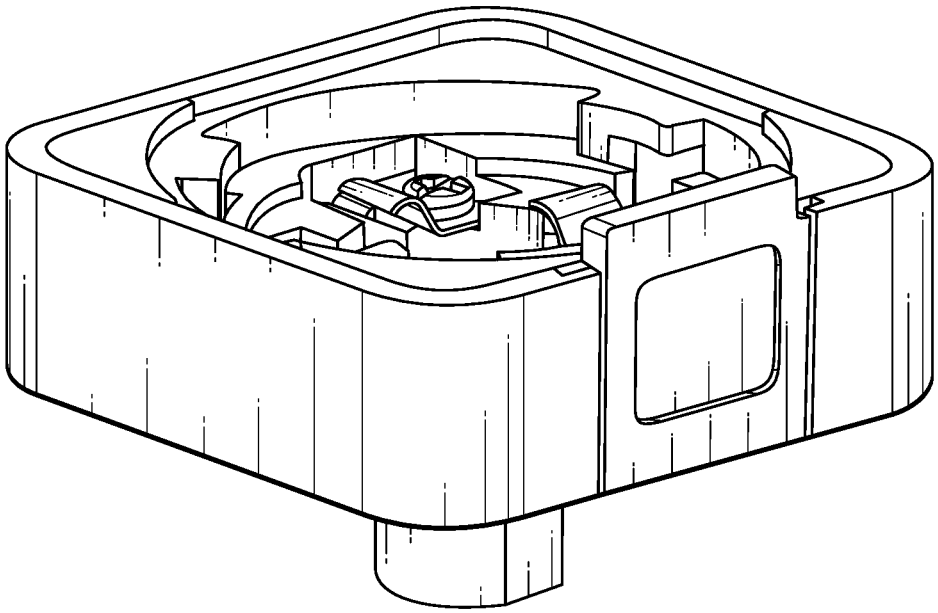
FIG. 5 is an isometric upper view of a luminaire adapter in accordance with the present disclosure with the track adapter removed, showing an inner recess, or cavity, defined in an upper surface of the luminaire adapter.
Figure 6:
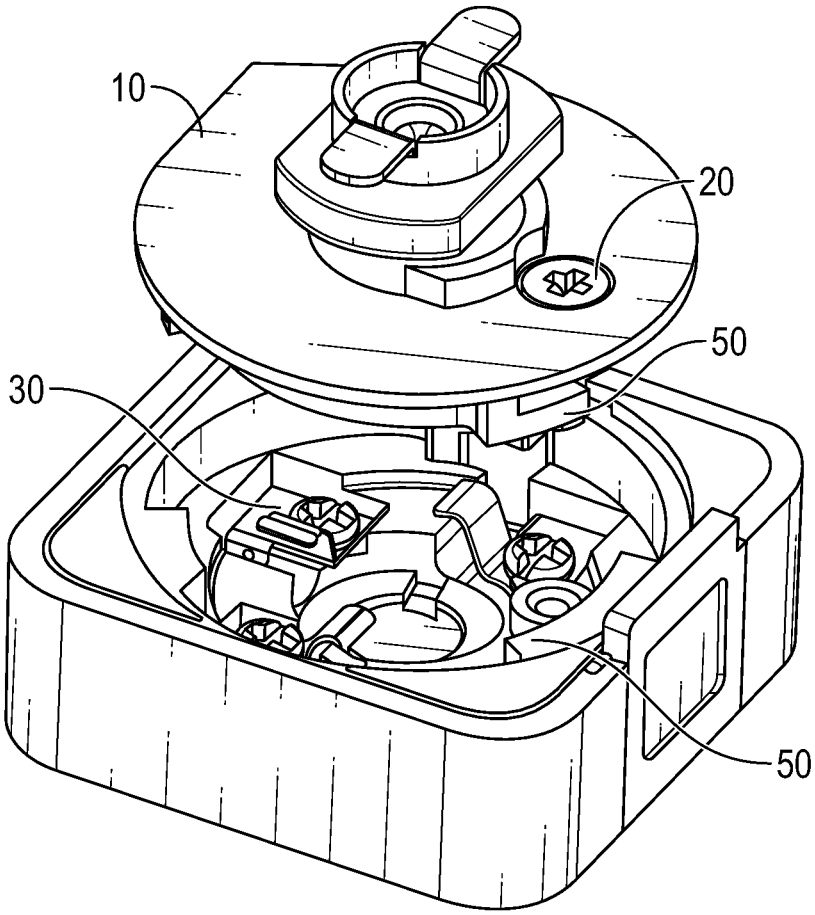
FIG. 6 is an isometric exploded view of a first representative embodiment of a track lighting adapter in accordance with the disclosure that is configured to couple a luminaire to a GLOBAL GB-67 type lighting track.

FIG. 4 is an isometric view of a second representative set of track lighting adapters in accordance with the present disclosure configured to couple a luminaire to a GLOBAL GB-67 type lighting track, a HALO® type lighting track, and a LIGHTOLIER® type lighting track. FIG. 5 is an isometric upper view of a luminaire adapter in accordance with the present disclosure with the track adapter removed, showing an inner recess, or cavity, defined in an upper surface of the luminaire adapter. FIG. 6 is an isometric exploded view of a first representative embodiment of a track lighting adapter in accordance with the disclosure that is configured to couple a luminaire to a GLOBAL GB-67 type lighting track.

As illustrated in FIGS. 4-6, the track adapter can be configured to be locked in place with respect to the luminaire adapter by moving the track adapter from a first position to a second position after the track adapter has been inserted into the recess of the luminaire adapter. This can be done by sliding, and or rotating the track adapter with respect to the luminaire adapter.

The implementation of FIGS. 4-6 utilizes a twist lock or keyed connection wherein tabs 40 defined within the recess are engaged by arms 50 that depend downwardly from the track adapter 10. Electrical contacts 30 are provided within the luminaire adapter that contact corresponding conductor pads on the underside of the track adapter (e.g., FIG. 7) once the track adapter is twist-locked into place. If desired, a fastener, such as a screw 20, can be provided that holds the track adapter in place with respect to the luminaire adapter. But, it will be appreciated that other kinds of fasteners can be used, such as clips, barbs, snap fit connections, and the like.

As will be appreciated, the illustrated adapter body, but for the recess at the top thereof, can otherwise be configured as an industry standard adapter with a conventional wired connection to the luminaire adapter and permit limited rotation of the luminaire with respect to the adapter body (e.g., up to 350 or 355 degrees, so as to prevent wires from becoming tangled or disconnected due to excessive rotation). As will further be understood, the adapter can be any shape (e.g., cylindrical, rectangular and the like).

The systems and methods of the present disclosure, as described above and shown in the drawings provide for improved track lighting adapters. It will be apparent to those skilled in the art that various modifications and variations can be made in the devices and methods of the present disclosure without departing from the spirit or scope of the disclosure. Thus, it is intended that the present disclosure include modifications and variations that are within the scope of the subject disclosure and equivalents.

What is claimed is:

1. A track lighting adapter to couple a luminaire to a lighting track, comprising:

a luminaire adapter to couple to the luminaire, the luminaire being defined by a main body portion, wherein the main body portion includes an upper end that includes a peripheral wall that at least partially surrounds and defines a cavity in an upper end face of the luminaire adapter, the cavity having a floor, the floor of the cavity including a first plurality of conductors extending therethrough, each of said conductors terminating in an upwardly facing conductive pad; and a track adapter to couple to the lighting track, wherein:

the track adapter is selectively removable from the luminaire adapter, the track adapter includes a lower plate that is configured to be received at least partially within the cavity of the luminaire adapter by sliding the lower plate into the cavity along a direction perpendicular to the floor of the cavity;

the lower plate includes a second plurality of conductors that are configured to make electrical contact with the first plurality of conductors when the lower plate is received within the cavity, and after the luminaire adapter and track adapter are coupled together, the luminaire adapter is not vertically displaceable relative to the track adapter.

2. The track lighting adapter of claim 1, wherein the track adapter is configured to couple to a HALO® type lighting track.

3. The track lighting adapter of claim 1, wherein the track adapter is configured to couple to a JUNO® type lighting track.

4. The track lighting adapter of claim 1, wherein the track adapter is configured to couple to a LIGHTOLIER® type lighting track.

5. The track lighting adapter of claim 1, wherein the track adapter is configured to couple to a GLOBAL GB-67 type lighting track.

6. The track lighting adapter of claim 1, wherein the first plurality of conductors of the luminaire adapter do not extend upwardly beyond an upper peripheral edge of the peripheral wall.

7. The track lighting adapter of claim 1, wherein the track adapter includes a first downwardly extending alignment guide that extends downwardly into a vertical channel formed into a side face of the luminaire adapter.

8. The track lighting adapter of claim 7, wherein the track adapter and luminaire adapter are coupled together by at least one threaded fastener passing through at least a portion of the track adapter into the luminaire adapter.

9. The track lighting adapter of claim 8, wherein the track adapter and luminaire adapter are coupled together by a snap fit.

10. The track lighting adapter of claim 1, wherein the lower plate of the track adapter includes a first plurality of horizontally extending tabs that configured to slide past a second plurality of horizontally extending tabs formed within the cavity of the luminaire adapter, and further wherein the first plurality of horizontally extending tabs are configured to lock underneath the second set of horizontally extending tabs when the luminaire adapter is rotated with respect to the track adapter from a first rotational position to a second rotational position about a vertical central axis of the track lighting adapter, and further wherein after the luminaire adapter and track adapter are coupled together in the second rotational position, the luminaire adapter is not vertically displaceable relative to the track adapter.

11. The track lighting adapter of claim 10, wherein the first plurality of horizontally extending tabs extend radially outwardly, and the second set of horizontally extending tabs extend radially inwardly.

12. The track lighting adapter of claim 11, wherein the second set of horizontally extending tabs include an "L"-shaped cross section, and are defined by a first, upper surface that contacts a lower surface of a respective tab of the track adapter, and a second, upwardly extending portion that receives a vertical edge of the respective tab of the track adapter to act as a rotation stop for the track adapter within the luminaire adapter.

13. The track lighting adapter of claim 10, wherein (i) the lower plate of the track adapter is circular in shape, (ii) the cavity in the upper end face is circular, and (iii) the lower plate of the track adapter is received by and is configured to rotate within the cavity of the upper end face to guide the first plurality of horizontally extending tabs into engagement with the second set of horizontally extending tabs.

14. The track lighting adapter of claim 13, wherein the first plurality of conductors are brought into electrical contact with the second plurality of conductors when the track adapter is rotated with respect to the luminaire adapter from the first position to the second position.

* * * * *